United States Patent [19]

Abe

[11] Patent Number: 5,000,718

[45] Date of Patent: Mar. 19, 1991

[54] COIN DISPENSING APPARATUS

[75] Inventor: Hiroshi Abe, Tokyo, Japan

[73] Assignee: Asahi Seiko Kabushiki Kaisha, Tokyo, Japan

[21] Appl. No.: 358,836

[22] Filed: May 30, 1989

[30] Foreign Application Priority Data

Jun. 4, 1988 [JP] Japan ..... 63-136665
Dec. 27, 1988 [JP] Japan ..... 63-327535

[51] Int. Cl.[5] ..... G07D 1/00
[52] U.S. Cl. ..... 453/57; 221/203
[58] Field of Search ..... 453/57, 12, 32, 49; 221/182, 203

[56] References Cited

U.S. PATENT DOCUMENTS 3,788,334 1/1974 Saraceno et al. ..... 453/57
3,818,918 6/1974 Nissmo et al. ..... 453/57
4,589,433 5/1986 Abe ..... 221/203 X

*Primary Examiner*—F. J. Bartuska
*Attorney, Agent, or Firm*—Nilles & Nilles

[57] ABSTRACT

In a coin dispensing apparatus comprising a hopper for holding a supply of coins in bulk and a coin transporting rotary disc rotatably disposed within the hopper for delivering coin from the hopper, a carrier having a plurality of coin transporting pins and/or agitating members spaced apart in the circumferential direction is rotatably supported at the rear side of the rotary disc to rotate at an angle to the rotary disc such as to extend the coin transporting pins and/or agitating members into the hopper from the surface of the rotary disc in a minimum amount at a position of a delivery portion and in a maximum amount at a coin picking up position, whereby a coin dispensing efficiency is remarkably improved without miscounting and jamming of coin at the delivery portion.

8 Claims, 10 Drawing Sheets

COIN DISPENSING APPARATUS

BACKGROUND OF THE INVENTION

1. Field of the Invention

The present invention relates to a coin dispensing apparatus for use in coin exchangers, coin operated gaming machines or the like and more particularly to such a coin dispensing apparatus comprising a hopper for holding a supply of coins or tokens in bulk and a rotary disc for dispensing coins one at a time and in predetermined quantities.

2. Description of the Prior Art

Hitherto, such a coin dispensing apparatus is known as disclosed in Japanese Patent Application Publication No. 62-45,588 (U.S. Pat. No. 4,589,433). As shown in FIG. 10, such a known coin dispensing apparatus comprises a hopper for holding a supply of coins in bulk and a rotary disc 3 rotatably disposed at one side within the hopper 1 at an angle to the horizontal. The rotary disc 3 has a central circular stage 4 provided at the central portion thereof and a plurality of coin transporting pins 5 arranged in a peripheral portion 3*a* around the central circular stage 4 such as to receive one coin between two sequential transporting pins 5, 5 spaced apart in the peripheral direction of the rotary disc 3. The coin dispensing apparatus further comprises a delivery guide 7 and an outlet chute 6 which are fixed to a stationary frame at an upper delivery portion 3*b*. The delivery guide 7 extends from the outlet chute 8 to an upper periphery 4*a* of the central stage across the peripheral portion 3*a* of the rotary disc 3 in the upper delivery portion 3*b* and has a tunnel passage for passing the transporting pin 5. Thus, when the rotary disc is rotated, a coin is transported from the bottom portion of the hopper 1 to the outlet chute 6 at the upper delivery portion 3*b* by each of the transporting pins 5 which project from the surface of the rotary disc 3 and pass through the tunnel passage in the delivery guide 7.

Aforementioned coin dispensing apparatus of prior art has a disadvantage in that the size of the coin transporting pin is limited since a large transporting pin can carry two or more coins at a time so that a coin counting device usually provided at the front of the outlet chute would make a miscount or the inlet of the outlet chute would be jammed with coins and further the dimension of the tunnel passage in the delivery guide must be increased. On the other hand, in order to improve the function of picking up a coin from a gutter formed at a lower portion of the hopper, it is desirable to make the length of the coin transporting pin sufficiently large to efficiently pickup the coin from the gutter.

In order to improve coin dispensing efficiency it is also desired to make the length of the coin agitating members protruded from the surface of the central stage of the rotary disc as long as possible and/or to locate on the central stage away from the center axis of the rotary disc in the radial direction, but the coin agitating members are also limited owing to the same reasons as for the coin transporting pin.

SUMMARY OF THE INVENTION

The object of the present invention is to improve the function of picking up coins from the bottom portion in a hopper by use of a long transporting pin without miscounting and jamming coins in the upper delivery portion.

Another object of the present invention is to improve the coin dispensing efficiency by providing unique means for agitating coins in the lower portion of a hopper without miscounting and jamming coins in the upper delivery portion and increasing load for agitating coins.

According to one aspect of the present invention, in a coin dispensing apparatus comprising a hopper for holding a supply of coins or takens in bulk, a rotary disc rotatably disposed within the hopper and provided with a central circular stage, a plurality of coin transporting pins which are protruded in a peripheral portion around the central circular stage and spaced apart in the peripheral direction of the rotary disc, and a coin delivery guide extended across the peripheral portion of the rotary disc for guiding coins on the peripheral portion to an outlet chute, a carrier having a plurality of coin transporting pins spaced apart in the circumferential direction is rotatably supported at the rear side of the rotary disc to rotate at an angle to the rotary disc such as to extrude the pins extended through the rotary disc from the surface of the peripheral portion of the rotary disc in a minimum amount at a position of the delivery guide and in a maximum amount at a coin picking up position.

According to another aspect of the present invention, in a coin dispensing apparatus comprising a hopper for holding a supply of coins in bulk, a rotary disc rotatably disposed within the hopper and provided with a central circular stage, a plurality of coin transporting pins which are protruded in a peripheral portion around the central circular stage and spaced apart in the peripheral direction of the rotary disc, and a coin delivery guide extended across the peripheral portion of the rotary disc for guiding coins on the peripheral delivery portion to an outlet chute, a carrier having a plurality of coin agitating members spaced apart in the circumferential direction is rotatably supported at the rear side of the rotary disc to rotate at an angle to the rotary disc such as to extrude coin agitating members extended through the rotary disc from the surface of the central circular stage of the rotary disc in a minimum amount at a position of the delivery portion and in a maximum amount at a coin picking up position.

According to a preferred embodiment of the present invention, wherein the rotary disc is rotatably disposed at one side within the hopper at an angle to the horizontal.

According to a preferred embodiment of the present invention, the carrier has a plurality of coin transporting pins spaced apart in the circumferential direction and extended through the peripheral portion of the rotary disc and a plurality of coin agitating members spaced apart in the circumferential direction and extended through the central circular stage of the rotary disc.

DETAILED DESCRIPTION OF THE PREFERRED EMBODIMENTS

Figure 1:
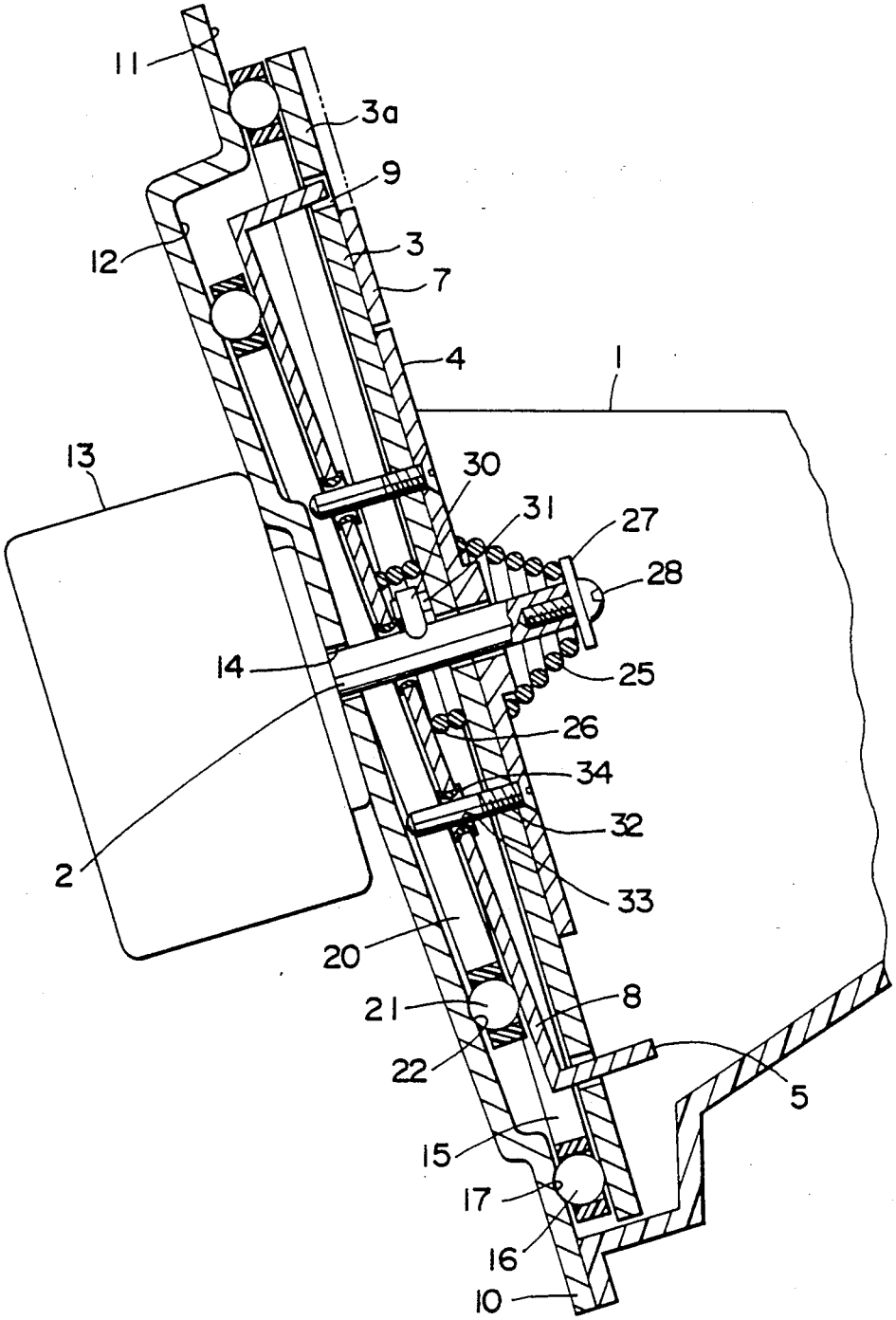
FIG. 1 is a sectional view illustrating an embodiment of the coin dispensing apparatus according to the present invention.
Figure 2:
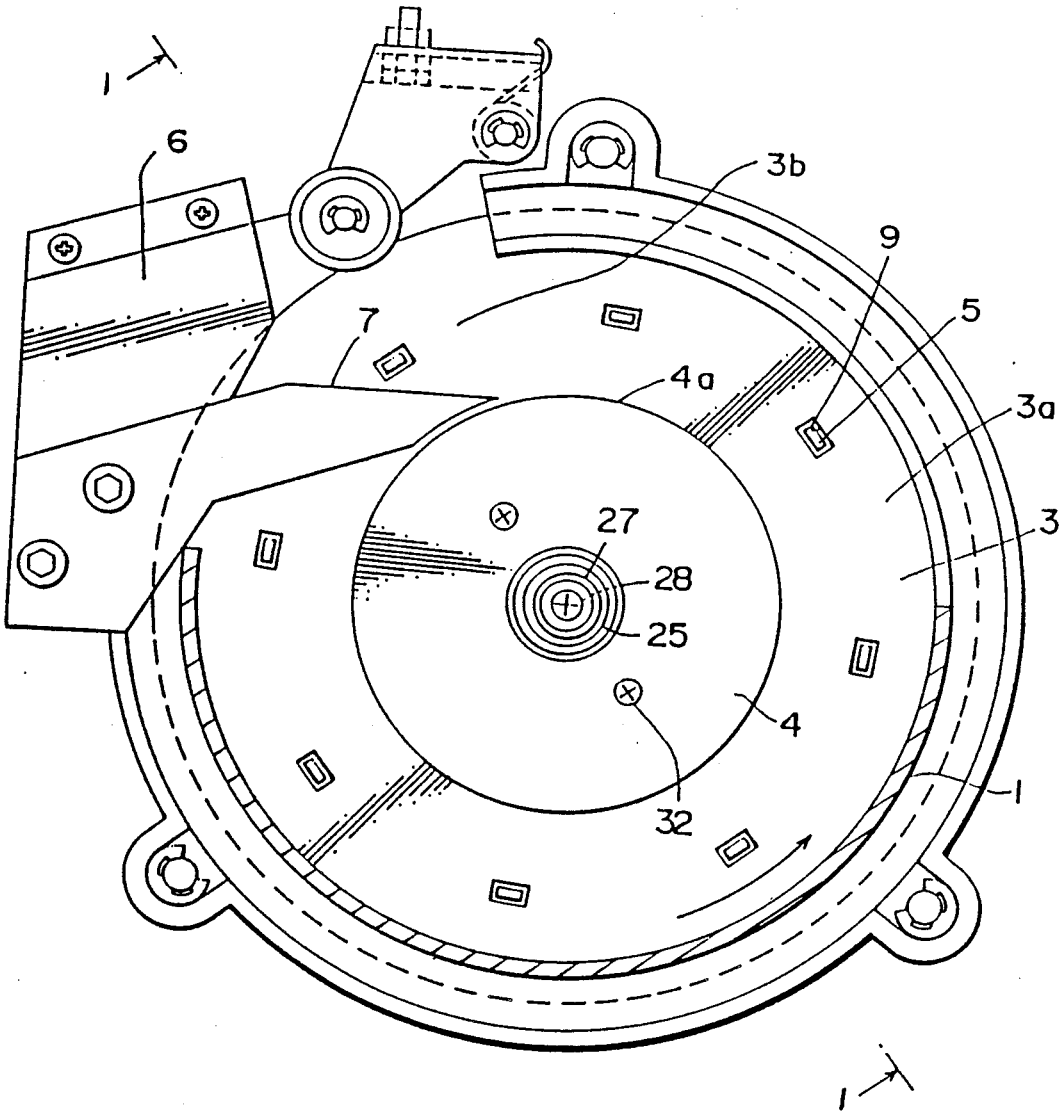
FIG. 2 is a front view of the embodiment shown in FIG. 1.

Referring to FIGS. 1 and 2 illustrating a first embodiment of the coin dispensing apparatus according to the present invention, a hopper 1 is connected to a stationary supporting plate 10 which is fixedly mounted on a conventional supporting stand in a position inclined to the horizontal in a known manner. The supporting plate 10 is provided with a rotary disc supporting surface 11 for supporting a rotary disc 3 with a central circular stage 4 and a carrier supporting surface 12 inclined relative to the rotary disc supporting surface 11 for supporting a disc shaped carrier 8. A rotating shaft 2 is driven by means of a motor 13 and is extended through a central hole 14 in the supporting plate 10. A first peripheral bearing means comprises a plurality of rotary disc supporting balls 16 spaced from each other in the circumferential direction and rotatably retained by means of a retainer ring 15 and then positioned in a first circular race 17 formed in the supporting surface 11 on the supporting plate 10. A second peripheral bearing means comprises a plurality of carrier supporting balls 21 also spaced from each other in the circumferential direction and rotatably retained by means of a retainer ring 20 and then positioned in a second circular race 22 formed in the supporting surface 12 on the supporting plate 10. As shown in FIG. 1, the rotary disc 3 has a first diameter, and the carrier 8 has a second diameter which is less than the rotary disc first diameter to expose the undersurface of the peripheral portion 3*a* for mounting on the first bearing means 16, 17. Also, as shown in FIG. 1, the carrier 8 has a radially outer peripheral area presenting an inner side mounted on the second bearing means 21, 22. The rotary disc 3 and the carrier 8 are rotatably supported on the rotating shaft 2 at their central holes, respectively. The carrier 8 is provided with a plurality of coin transporting pins 5 which are protruded from the surface toward the rotary disc 3 and spaced apart in the circumferential direction. The coin transporting pins 5 are respectively inserted in holes 9 which are formed in a peripheral portion 3*a* of the rotary disc 3 and spaced apart in the circumferential direction by the same space as that existing between the coin transporting pins. A first biasing means in the form of a spring 26 is interposed between the rotary disc 3 and the carrier 8 and a second biasing means in the form of a spring 25 is interposed between the rotary disc 3 and a washer 27 which is fixed to the top of the rotating shaft 2 by means of a screw 28 to thereby urge the central portions of the rotary disc 3 and the carrier 8 towards the stationary supporting plate 10 by means of springs 25 and 26, respectively to rotatably support the rotary disc 3 and the carrier 8 on the supporting plate through the balls 16 and 21, respectively.

The rotating shaft 2 is provided with a driving shaft 2 30 which is laterally extended from the pin, while the rotary disc 3 is provided with a driven pin 31 which is protruded from the under surface of the rotary disc such as to be drivingly engaged with the driving pin 30, whereby the rotary disc 3 is driven by the rotating shaft 2. A plurality of drive screw members 32 are threaded in tapped holes in the central circular stage 4 and the rotary disc 3 and extended through bearings 34 at drive screw receiving holes 33 formed in the carrier 8 to thereby drivingly connect the carrier 8 to the rotary disc 3.

In operation, when the rotary disc 3 is rotated by the rotating shaft 2, the carrier 8 is integrally rotated with the rotary disc 3, but in an inclined position in respect to the rotary disc 3. Accordingly, the coin transporting pins 5 extended from the front surface of the lower peripheral portion of the rotary disc 3 into the bottom portion of the hopper 1 in a maximum protrusion amount at a coin picking up position which is substantially diametrically opposed to the position of the delivery guide 7 at the upper delivery portion 3*b* and the protrusion amount of the coin transporting pins subsequently decreases to a protrusion amount corresponding to a thickness of one coin at the front of the outlet chute 6 as the rotary disc 3 is rotated and the coin transporting pins 5 approach the outlet chute 6 at the upper delivery portion 3*b*. When the coin transporting pin 5 reaches the position of the delivery guide 7 at the upper delivery portion 3*b*, the coin transporting pin 5 is substantially withdrawn in the hole 9 as shown in FIG. 1. The coin transporting pin 5 is again extended from the surface of the peripheral portion 3*a* of the rotary disc 3 after passing the position of the delivery guide 7 and the extrusion amount of the pin 5 subsequently increases to the maximum amount.

According to the present invention, it is able to effect a high picking up and agitating efficiency by the coin transporting pin 5, without any interference with the delivery guide 7 and the miscounting and jamming of coins at the upper delivery portion, so that the coin dispensing efficiency and the reliability in the operation of the coin dispensing apparatus are remarkably improved.

In the aforementioned embodiment, the rotary disc 3 is arranged within the hopper 1 at an angle to the horizontal, but the rotary disc 3 may be arranged to rotate in a horizontal position.

Figure 3:
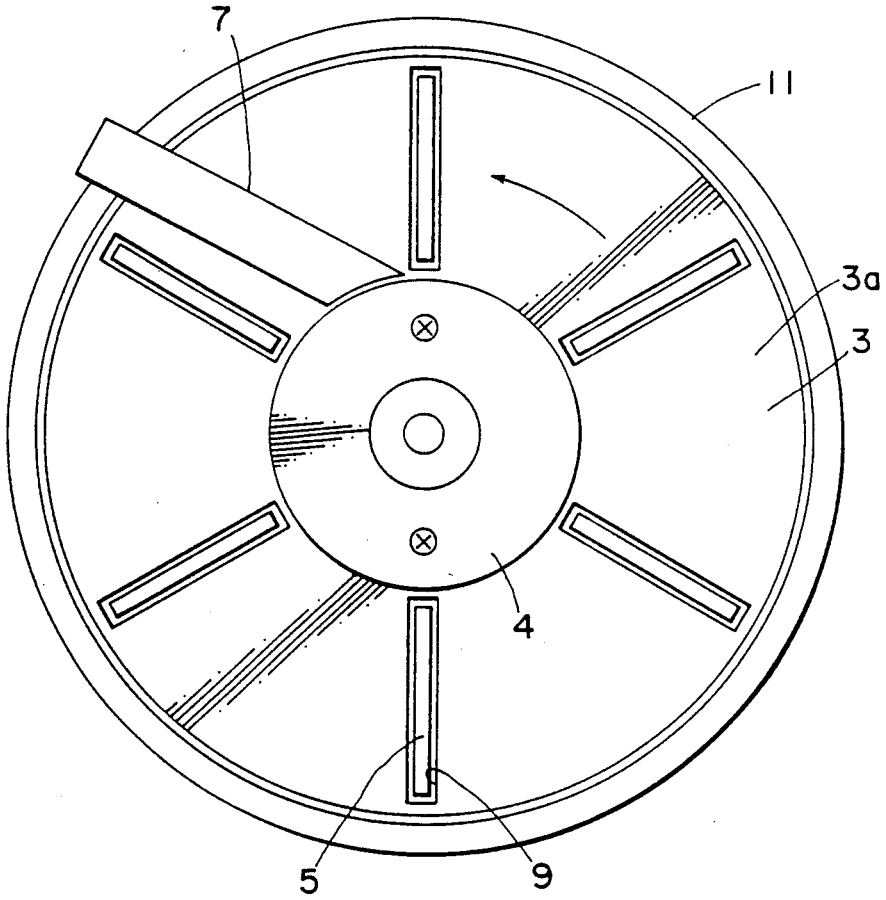
FIG. 3 is a front view similar to FIG. 2 illustrating another embodiment of the present invention.

FIG. 3 shows another embodiment, wherein the coin transporting pin 5 has a large dimention in the radial direction.

Figure 4:
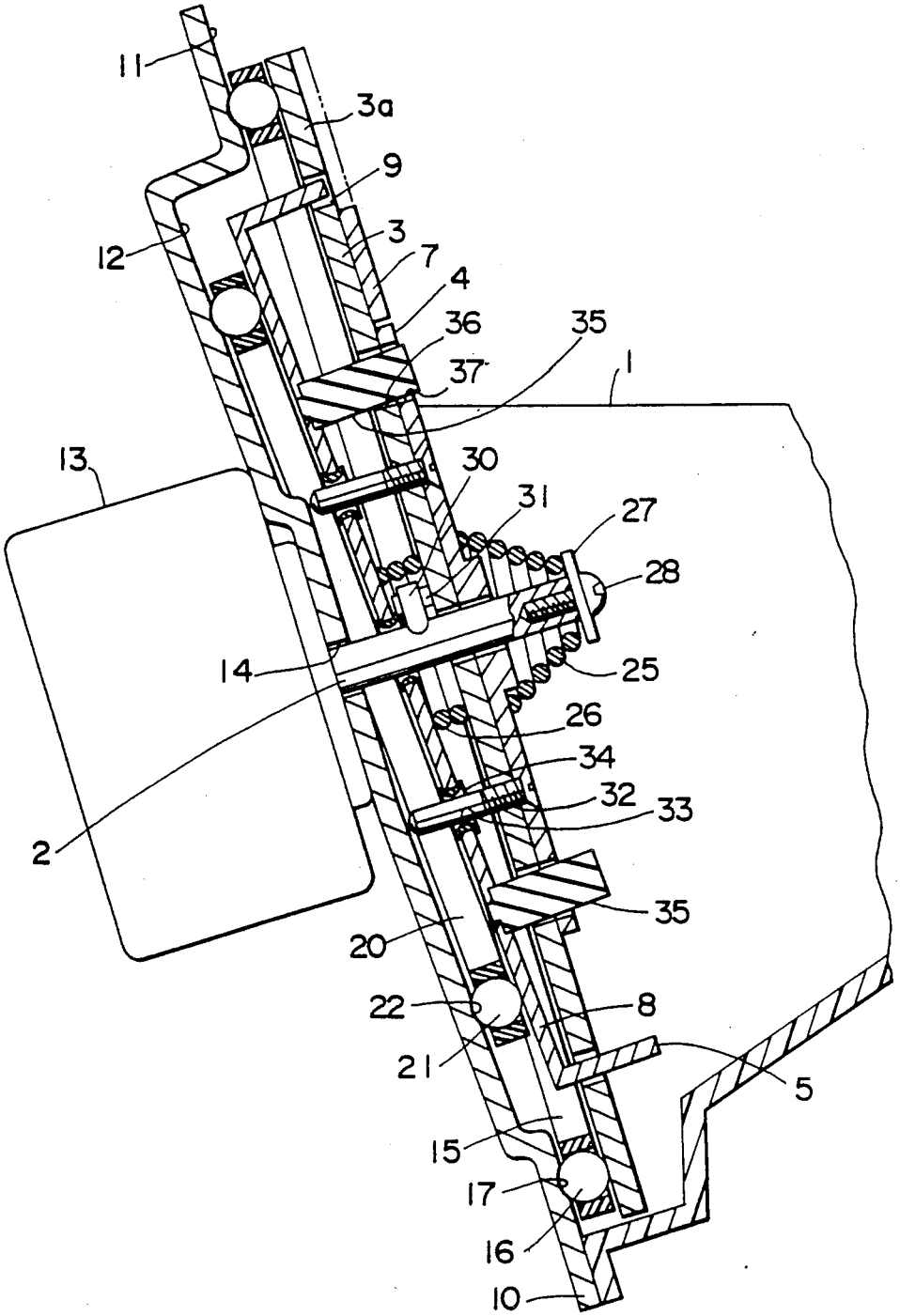
FIG. 4 is a sectional view illustrating another embodiment of the present invention.
Figure 5:
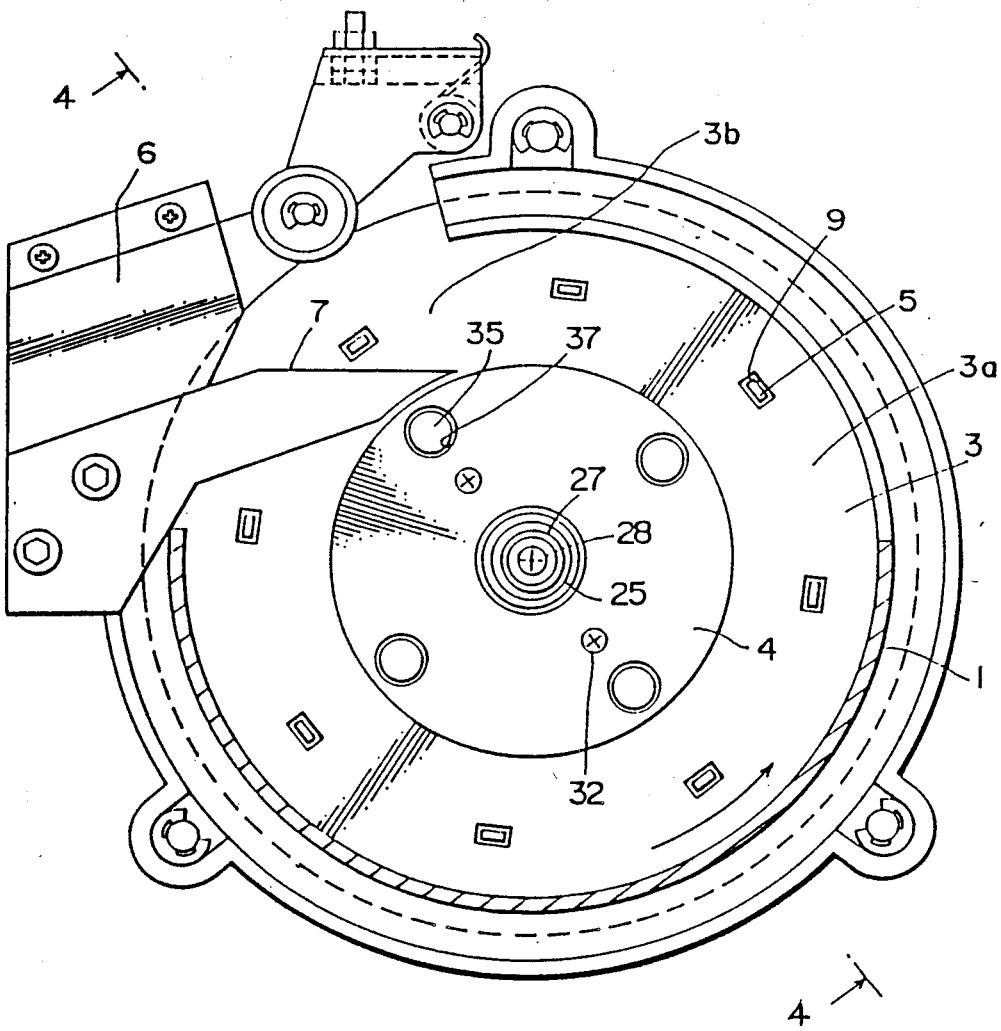
FIG. 5 is a front view of the embodiment shown in FIG. 4.

FIGS. 4 and 5 show a third embodiment of the present invention. In this embodiment, a plurality of rod shaped agitating members 35 are secured to the inclined carrier 8 such as to extended through holes 36 and 37 formed in the rotary disc 3 and the central circular stage 4.

Figure 6:
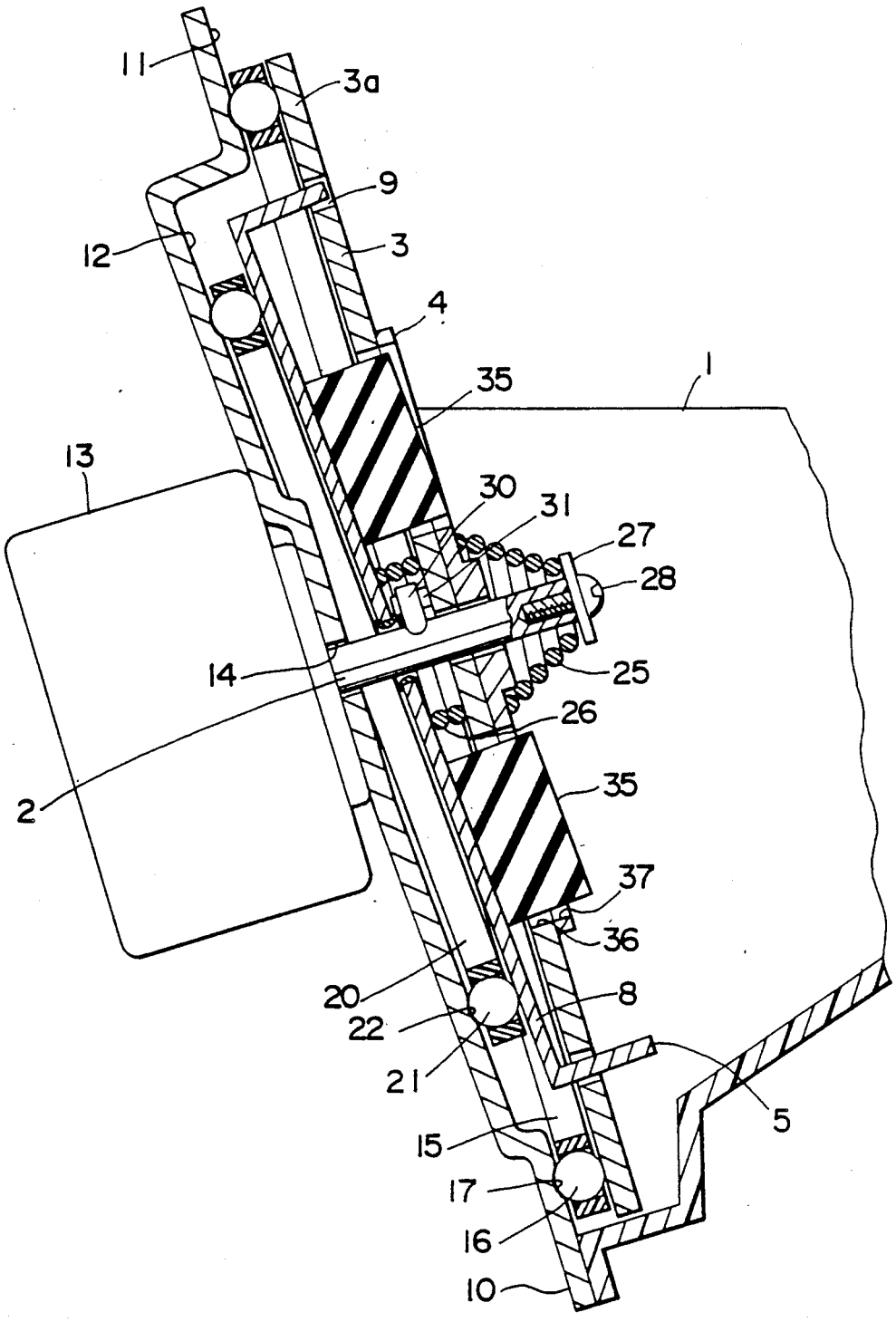
FIG. 6 is a sectional view illustrating another embodiment of the present invention.
Figure 7:
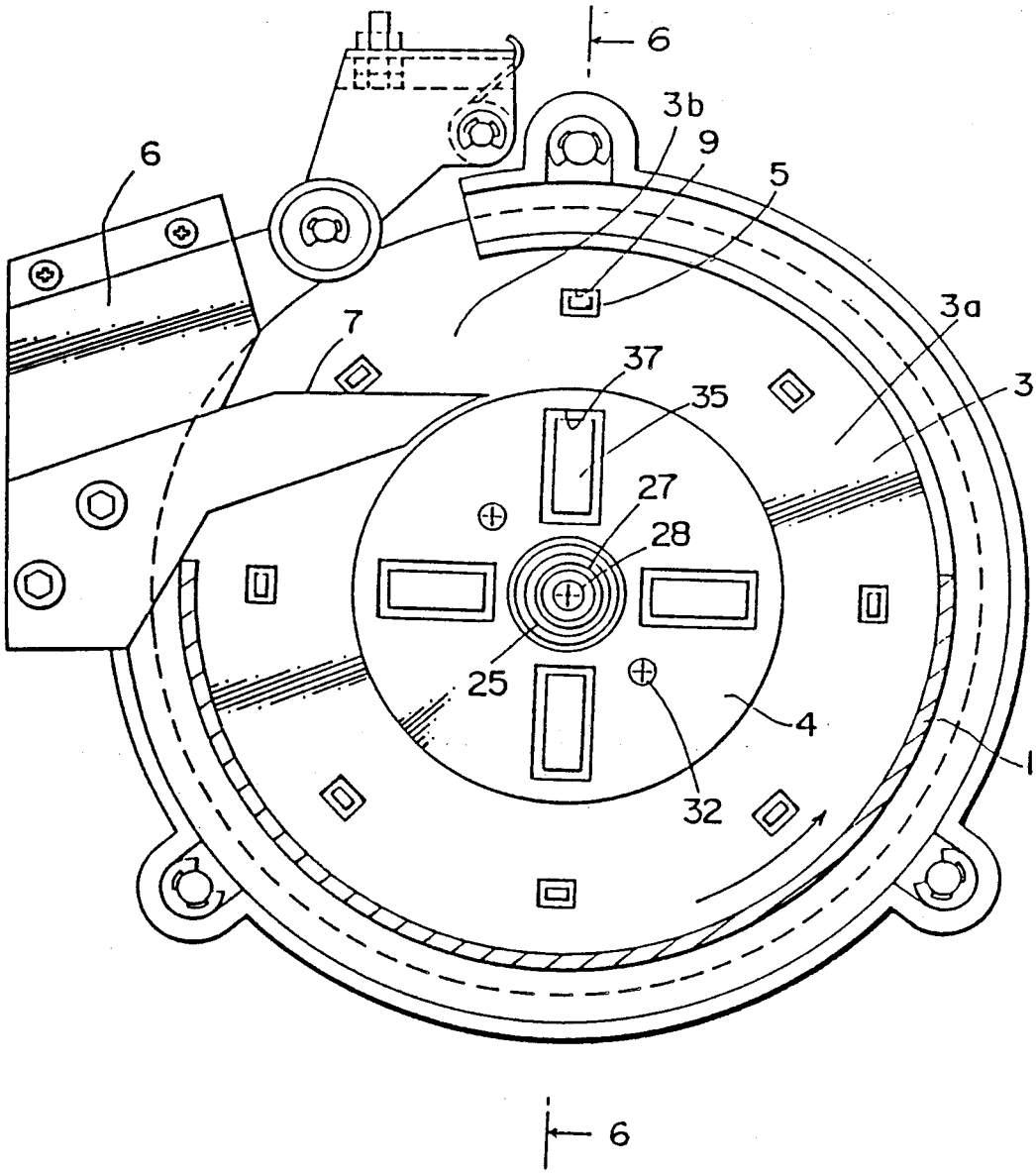
FIG. 7 is a front view of the embodiment shown in FIG. 6.

FIGS. 6 and 7 show another embodiment which is similar to the embodiment shown in FIGS. 4 and 5, wherein the coin agitating members 35 are extended in the radial direction of the central circular stage 4.

Figure 8:
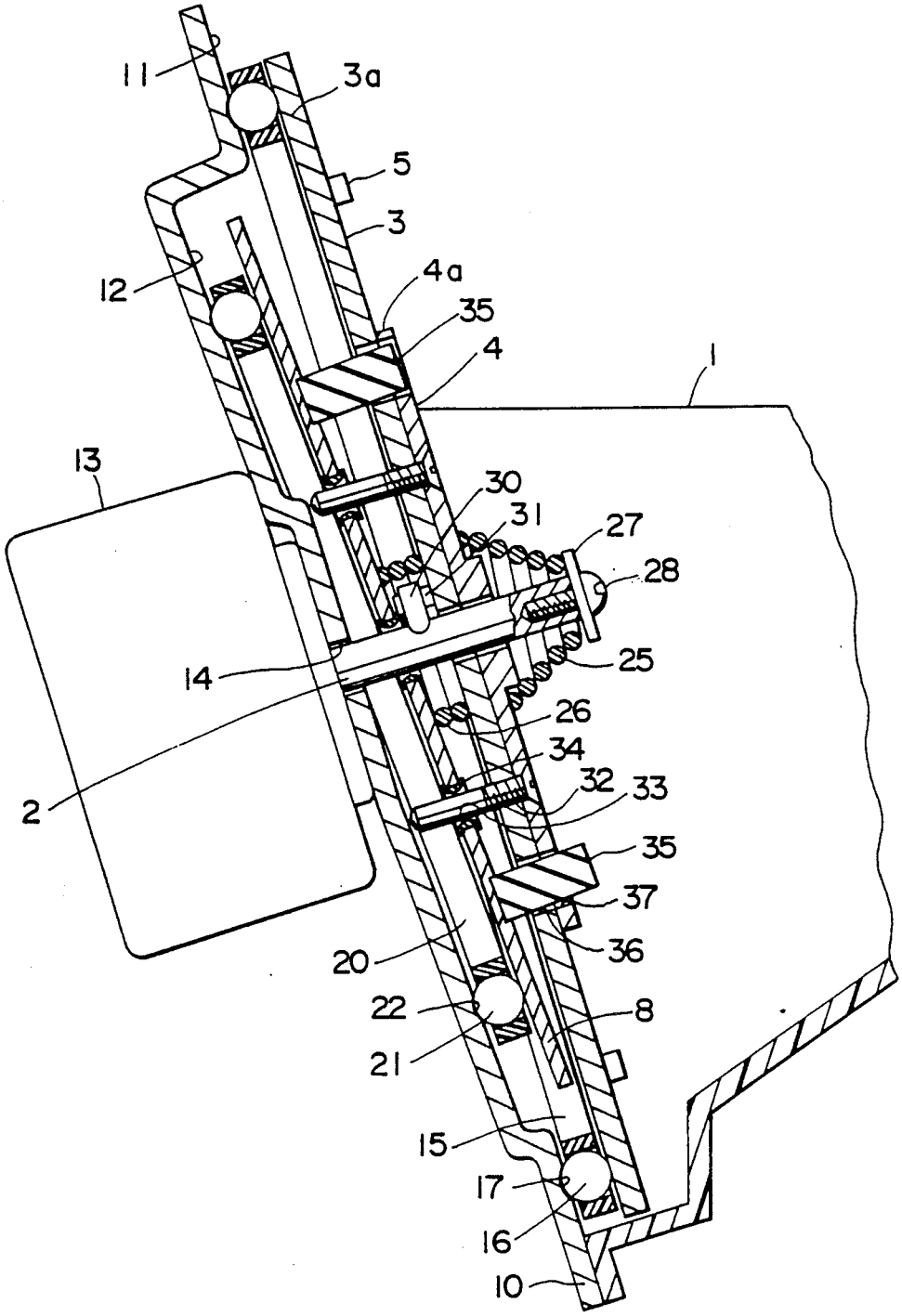
FIG. 8 is a sectional view illustrating another embodiment of the present invention.
Figure 9:
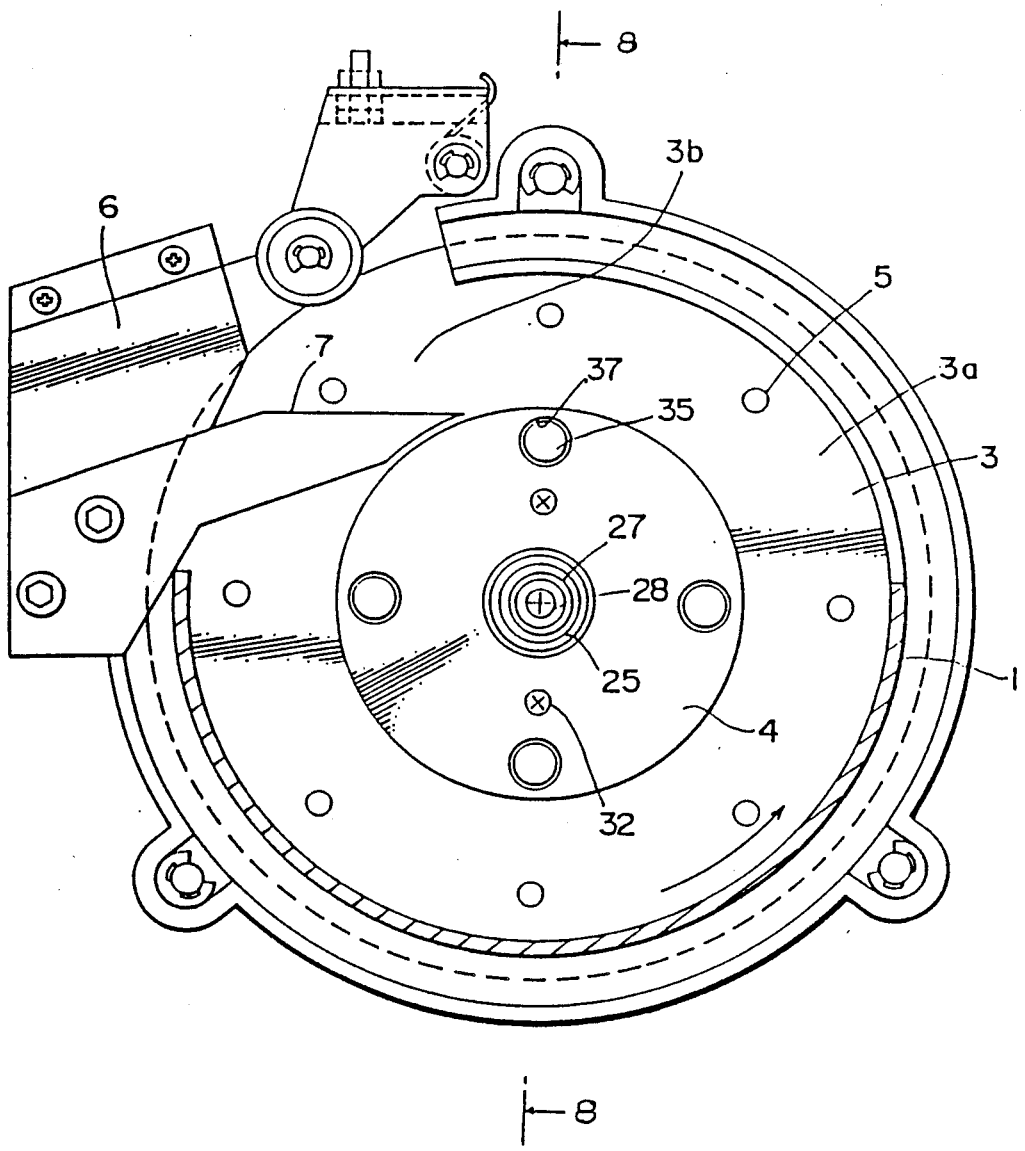
FIG. 9 is a front view of the embodiment shown in FIG. 8.
Figure 10:
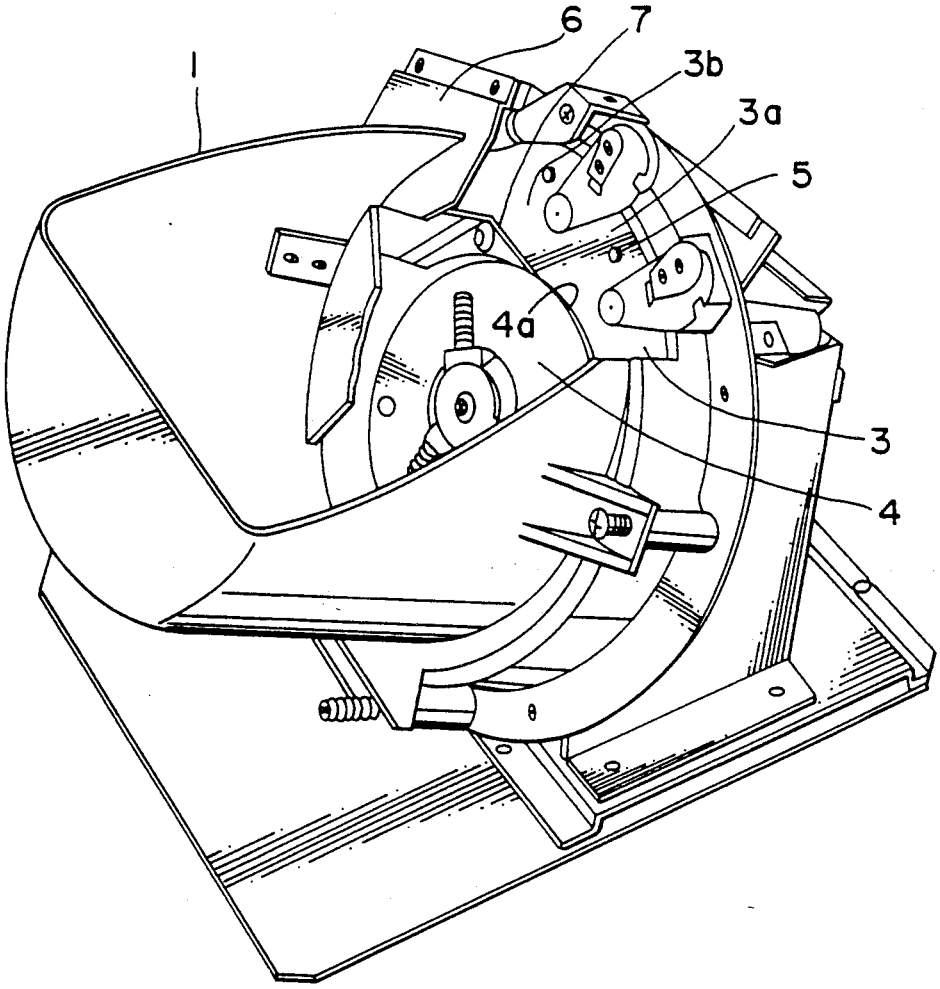
FIG. 10 is a perspective view of the illustrative coin dispensing apparatus of prior art.

FIGS. 8 and 9 show another embodiment of the present invention which is similar to the embodiment shown in FIGS. 4 and 5 except for providing the coin transporting pins 5 integrally on the surface of the peripheral portion 3*a* of the rotary disc 3.

What is claimed is:

1. A coin dispensing apparatus comprising:

a supporting plate (10) having supporting surfaces (11, 12) presenting first and second peripheral bearing means (16, 17 and 21, 22);

a hopper (1) for holding a supply of coins in bulk mounted on said support plate and having an outlet chute (6);

a rotary disc (3) having a peripheral portion (3*a*) including an undersurface, a coin picking up portion, a front surface, a central circular stage (4) and a plurality of circumferentially spaced transport pin receiving holes (9) around said central stage, and said undersurface mounted on said first peripheral bearing means to rotatably support said disc in said hopper;

a coin delivery guide (7) mounted to extend across said peripheral portion of said rotating disc for guiding coins on said peripheral portion to said outlet chute; and a carrier (8) having a plurality of coin transporting pins projecting therefrom through said transport pin receiving holes in said rotary disc, and a radially outer peripheral area presenting an inner side mounted on said second peripheral bearing means to rotatably support said carrier in said hopper, said carrier being rotatable in a plane extending at an acute angle to said rotary disc so as to cause said pins which extend through said pin receiving holes in said rotary disc to project a minimum amount from said front surface at said delivery guide and to project a maximum amount at said coin picking up position.

2. A coin dispensing apparatus according to claim 1, wherein said rotary disc (3) has a first diameter; and said carrier (8) has a second diameter which is less than said first diameter to expose said undersurface of said rotary disc peripheral portion for mounting on said first bearing means.

3. A coin dispensing apparatus according to claim 2, wherein said supporting plate surfaces include a peripheral disc supporting surface (11) and a peripheral carrier supporting surface 12:

said peripheral disc supporting surface presenting a first bearing race (17) in facing relation to said undersurface of said rotary disc peripheral portion; and said peripheral carrier supporting surface presenting a second bearing race (22) in facing relation to said inner side of said radially outer peripheral area of said carrier (8).

4. A coin dispensing apparatus according to claim 1, wherein:

said carrier (8) includes drive screw receiving holes (33); and said rotary disc includes drive screw members (32) mounted to project from said undersurface and through said drive screw receiving holes (33) in said carrier to transmit driving force thereto and thereby prevent said carrier transport pins from contacting said rotary disc.

5. A coin dispensing apparatus according to claim 1, wherein said rotary disc is rotatably disposed at one side within said hopper at an angle to the horizontal.

6. A coin dispensing apparatus according to claim 1, wherein said carrier is provided with a plurality of agitating members (35) spaced apart in the circumferential direction and extending through the central circular stage of the rotary disc.

7. A coin dispensing apparatus according to claim 1, wherein a biasing means (25, 26) is mounted to resiliently urge both said rotary disc and carrier toward said supporting plate and into engagement with said first and second bearing means.

8. A coin dispensing apparatus according to claim 7, wherein said biasing means comprises a first biasing means (26) mounted between said disc (3) and said carrier (8) and a second biasing means (25) mounted to constantly urge said disc toward said carrier and said supporting plate.

* * * * *